US011122350B1

(12) United States Patent
Lesso

(10) Patent No.: US 11,122,350 B1
(45) Date of Patent: Sep. 14, 2021

(54) METHOD AND APPARATUS FOR ON EAR DETECT

(71) Applicant: Cirrus Logic International Semiconductor Ltd., Edinburgh (GB)

(72) Inventor: John P. Lesso, Edinburgh (GB)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/996,230

(22) Filed: Aug. 18, 2020

(51) Int. Cl.

| | |
|---|---|
| ***H04R 3/00*** | (2006.01) |
| ***H04R 29/00*** | (2006.01) |
| ***H04R 1/10*** | (2006.01) |
| ***H04R 1/08*** | (2006.01) |

(52) U.S. Cl.
CPC ..... *H04R 1/10* (2013.01); *H04R 1/08* (2013.01); *H04R 3/005* (2013.01); *H04R 29/00* (2013.01)

(58) Field of Classification Search
CPC ..... H04R 1/08; H04R 1/10; H04R 1/1008; H04R 1/1041; H04R 3/00; H04R 3/005; H04R 29/00; H04R 29/001; G10K 11/16; G10K 11/187; G10K 11/17833; G10K 11/17835; G10K 11/17881
See application file for complete search history.

(56) References Cited

U.S. PATENT DOCUMENTS

| | | | | |
|---|---|---|---|---|
| 9,516,442 | B1 * | 12/2016 | Dusan | H04R 1/222 |
| 9,532,131 | B2 * | 12/2016 | Dusan | G10K 11/178 |
| 9,838,812 | B1 * | 12/2017 | Shetye | H04R 1/1041 |
| 9,913,022 | B2 * | 3/2018 | Dusan | G10L 21/0208 |
| 9,980,034 | B2 * | 5/2018 | Kumar | H04R 1/1008 |
| 10,354,639 | B2 * | 7/2019 | Scanlan | H04R 1/1083 |
| 2010/0246845 | A1 * | 9/2010 | Burge | H04R 1/1041 381/71.6 |
| 2014/0037101 | A1 * | 2/2014 | Murata | H04R 1/1041 381/74 |
| 2015/0281825 | A1 * | 10/2015 | Johnson | H04R 5/033 381/74 |
| 2020/0014996 | A1 * | 1/2020 | Kumari | H04R 3/04 |
| 2020/0145757 | A1 * | 5/2020 | Kraemer | G01P 3/44 |

* cited by examiner

*Primary Examiner* — Thang V Tran
(74) *Attorney, Agent, or Firm* — Jackson Walker L.L.P.

(57) ABSTRACT

A method for on ear detection for a headphone, the method comprising: receiving a first microphone signal derived from an first microphone of the headphone and determining, from the first microphone signal, a first resonance frequency associated with an acoustic port of the first microphone, the first resonance frequency dependent on a first temperature at the first microphone; receiving a second microphone signal derived from an second microphone of the headphone and determining, from the second microphone signal, a second resonance frequency associated with an acoustic port of the second microphone, the second resonance frequency dependent on a second temperature at the second microphone.

20 Claims, 6 Drawing Sheets

| $\vartheta_{int}$ matches body temp? \ $\vartheta_{ext}$ is in range? | NO | YES |
|---|---|---|
| NO | Undefined | On-ear |
| YES | Off-ear | Off-ear |

METHOD AND APPARATUS FOR ON EAR DETECT

TECHNICAL FIELD

The present disclosure relates to headsets, and in particular methods and systems for determining whether or not a headset is in place on or in the ear of a user.

BACKGROUND

Headsets are used to deliver sound to one or both ears of a user, such as music or audio files or telephony signals. Modern headsets typically also capture sound from the surrounding environment, such as the user's voice for voice recording or telephony, or background noise signals to be used to enhance signal processing by the device.

This sound is typically captured by a reference microphone located on the outside of a headset, and an error microphone located on the inside of the headset closets to the user's ear. A wide range of signal processing functions can be implemented using these microphones and such processes can use appreciable power, even when the headset is not being worn by the user.

It is therefore desirable to have knowledge of whether the headset is being worn at any particular time. For example, it is desirable to know whether on-ear headsets are placed on or over the pinna(e) of the user, and whether earbud headsets have been placed within the ear canal(s) or concha(e) of the user. Both such use cases are referred to herein as the respective headset being "on ear". The unused state, such as when a headset is carried around the user's neck or removed entirely, is referred to herein as being "off ear".

Previous approaches to on ear detection use sensors (capacitive, optical or infrared) to detect when a headset is brought close to the ear of a user. The provision of non-acoustic sensors adds hardware cost and power consumption. Other approaches analyse audio signals derived at microphone(s) of the headset to detect an on ear condition. Such approaches can be affected by noise sources such as wind noise, which in turn can lead to false positive outputs.

SUMMARY

According to a first aspect of the disclosure, there is provided a method for on ear detection for a headphone, the method comprising: receiving a first microphone signal derived from an first microphone of the headphone and determining, from the first microphone signal, a first resonance frequency associated with an acoustic port of the first microphone, the first resonance frequency dependent on a first temperature at the first microphone; receiving a second microphone signal derived from an second microphone of the headphone and determining, from the second microphone signal, a second resonance frequency associated with an acoustic port of the second microphone, the second resonance frequency dependent on a second temperature at the second microphone; and determining an indication of whether the headphone is on ear based on the first and second resonance frequencies.

Determining the indication of whether the headphone is on ear may comprise comparing the first and second resonance frequencies.

Determining the indication of whether the headphone is on ear may comprise determine the first temperature at the first microphone and the second temperature at the second microphone based on the respective first and second resonance frequencies; and determining the indication of whether the headphone is on ear based on the first and second temperatures.

Determining the indication of whether the headphone is on ear based on the first and second resonance frequencies may comprise comparing the first and second resonance frequencies.

Determining the indication of whether the headphone is on ear based on the first and second resonance frequencies may comprise detecting a change in the difference between the first and second resonance frequencies over time. In which case, the method may further comprise detecting an insertion event or a removal event based on the change in the difference between the first and second resonance frequencies over time.

The method may further comprise filtering the first and second resonance frequencies before determining whether the headphone is on ear. The filtering may comprise applying a median filter or a low pass filter to the first and second resonance frequencies.

Determining the indication of whether the headphone is on ear may comprise determining one or more derivatives of the first resonance frequency over time.

Determining the indication of whether the headphone is on ear may comprise determine a change in the first resonance frequency based on the one or more derivatives and the first resonance frequency. The one or more derivatives may comprise a first order derivative and/or a second order derivative. The one or more derivatives may be noise-robust. In some embodiments, a prediction filter is used to determine whether the headphone is on ear based on the one or more derivatives and the first resonance frequency. The prediction filter may be implemented as a neural network.

The method may further comprise comparing the first resonance frequency to a first resonance frequency range associated with the first microphone over a body temperature range; and determining that the headphone is on ear only if the first falls within the first resonance frequency range.

The method may further comprise comparing the second resonance frequency to a second resonance frequency range associated with the second microphone over an air temperature range; and determining that the headphone is on ear only if the first resonance frequency falls within the first resonance frequency range and the second resonance frequency falls within the second resonance frequency range.

According to another aspect of the disclosure, there is provided a method for on ear detection for a headphone, the method comprising: receiving a first microphone signal derived from a first microphone of the headphone and determining, from the first microphone signal, a first resonance frequency associated with the acoustic port of the first microphone, the first resonance frequency dependent on a first temperature at the first microphone; detecting a change in the first resonance frequency over time; and determining an indication of whether the headphone is on ear based on the change in resonance frequency and the resonance frequency after the change.

Determining the indication of whether the headphone is on ear may comprise determine a first temperature at the first microphone based on the first resonance frequency; and determining the indication of whether the headphone is on ear based on the first temperature.

The method may further comprise detecting an insertion event or a removal event based on the change in the resonance frequency and the resonance frequency after the change.

The method may further comprise filtering the first resonance frequency before determining whether the headphone is on ear.

Determining the change in the first resonance frequency may comprise determining one or more derivatives of the first resonance frequency over time. The one or more derivatives may comprise a first order derivative and/or a second order derivative. The one or more derivatives may be noise-robust.

In some embodiments, a prediction filter is used to determine whether the headphone is on ear based on the one or more derivatives and the first resonance frequency. The prediction filter may be implemented as a neural network.

In some embodiments, the method may further comprise: comparing the first resonance frequency to a first resonance frequency range associated with the first microphone over a body temperature range; and determining that the headphone is on ear only if the first resonance frequency falls within the first resonance frequency range.

In some embodiments, the indication of whether the headphone is one ear may be a probability indication that the headphone is on ear.

According to another aspect of the disclosure, there is provided an apparatus for on ear detection for a headphone, the apparatus comprising: a first input for receiving a first microphone signal derived from a first microphone of the headphone; a second input for receiving a second microphone signal derived from a second microphone of the headphone; one or more processors configured to: determine, from the first microphone signal, a first resonance frequency associated with an acoustic port of the first microphone, the first resonance frequency dependent on a first temperature at the first microphone; determine, from the second microphone signal, a second resonance frequency associated with an acoustic port of the second microphone, the second resonance frequency dependent on a second temperature at the second microphone; and determine an indication of whether the headphone is on ear based on the first and second resonance frequencies.

According to another aspect of the disclosure, there is provided an apparatus for on ear detection for a headphone, the apparatus comprising: an input for receiving a first microphone signal derived from a first microphone of the headphone; one or more processors configured to: determine, from the first microphone signal, a first resonance frequency associated with the acoustic port of the first microphone, the first resonance frequency dependent on a first temperature at the first microphone; detect a change in the first resonance frequency over time; and determine an indication of whether the headphone is on ear based on the change in resonance frequency and the resonance frequency after the change.

According to another aspect of the disclosure, there is provided an electronic device comprising the apparatus described above. The electronic device may comprise one of a smartphone, a tablet, a laptop computer, a games console, a home control system, a home entertainment system, an in-vehicle entertainment system, and a domestic appliance.

According to another aspect of the disclosure, there is provided a non-transitory computer readable storage medium having computer-executable instructions stored thereon that, when executed by one or more processors, cause the one or more processors to perform a method as described above.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

BRIEF DESCRIPTION OF DRAWINGS

Embodiments of the present disclosure will now be described by way of non-limiting examples with reference to the drawings, in which.

DESCRIPTION OF EMBODIMENTS

Embodiments of the present disclosure relate to the measurement of temperature dependent microphone characteristics for the purpose of determining whether a personal audio device is being worn by a user, or in other words is "on ear". These characteristics may be acquired from microphone signals acquired by a personal audio device. As used herein, the term "personal audio device" encompasses any electronic device which is suitable for, or configurable to, provide audio playback substantially only to a single user.

Figure 1:
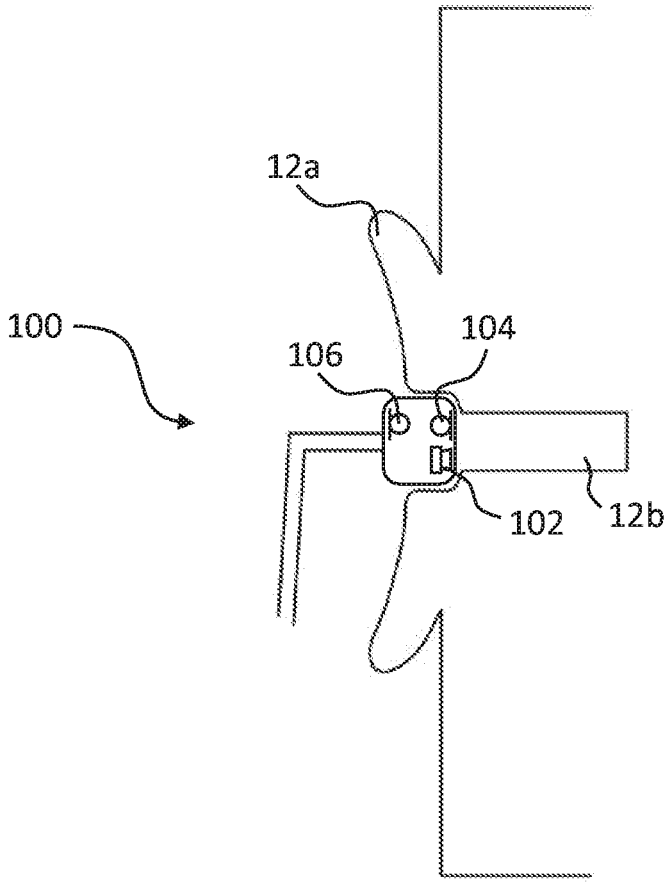
FIG. 1 is a schematic diagram of a user's ear and a personal audio device inserted into the user's ear.

FIG. 1 shows a schematic diagram of a user's ear, comprising the (external) pinna or auricle 12*a*, and the (internal) ear canal 12*b*. A personal audio device comprising an intra-concha headphone 100 (or earphone) sits inside the user's concha cavity. The intra-concha headphone may fit loosely within the cavity, allowing the flow of air into and out of the user's ear canal 12*b*.

The headphone 100 comprises one or more loudspeakers 102 positioned on an internal surface of the headphone 100 and arranged to generate acoustic signals towards the user's ear and particularly the ear canal 12*b*. The earphone further comprises one or more microphones 104, known as error microphone(s), positioned on an internal surface of the earphone, arranged to detect acoustic signals within the internal volume defined by the headphone 100 and the ear canal 12*b*. The headphone 100 may also comprise one or more microphones 106, known as reference microphone(s), positioned on an external surface of the headphone 100 and configured to detect environmental noise incident at the user's ear.

The headphone 100 may be able to perform active noise cancellation, to reduce the amount of noise experienced by the user of the headphone 100. Active noise cancellation typically operates by detecting the noise (i.e. with a microphone) and generating a signal (i.e. with the loudspeaker) that has the same amplitude as the noise signal but is opposite in phase. The generated signal thus interferes destructively with the noise and so lessens the noise experienced by the user. Active noise cancellation may operate on the basis of feedback signals, feedforward signals, or a combination of both. Feedforward active noise cancellation utilizes the one or more microphones 106 on an external surface of the headphone 100, operative to detect the environmental noise before it reaches the user's ear. The detected noise is processed, and the cancellation signal generated so as to match the incoming noise as it arrives at the user's ear. Feedback active noise cancellation utilizes the one or more error microphones 104 positioned on the internal surface of the headphone 100, operative to detect the combination of the noise and the audio playback signal generated by the one or more loudspeakers 102. This combination is used in a feedback loop, together with knowledge of the audio playback signal, to adjust the cancelling signal generated by the loudspeaker 102 and so reduce the noise. The microphones 104, 106 shown in FIG. 1 may therefore form part of an active noise cancellation system.

In the example shown in FIG. 1, an intra-concha headphone 100 is provided as an example personal audio device. It will be appreciated, however, that embodiments of the present disclosure can be implemented on any personal audio device which is configured to be placed at, in or near the ear of a user. Examples include circum-aural headphones worn over the ear, supra-aural headphones worn on the ear, in-ear headphones inserted partially or totally into the ear canal to form a tight seal with the ear canal, or mobile handsets held close to the user's ear so as to provide audio playback (e.g. during a call).

Figure 2:
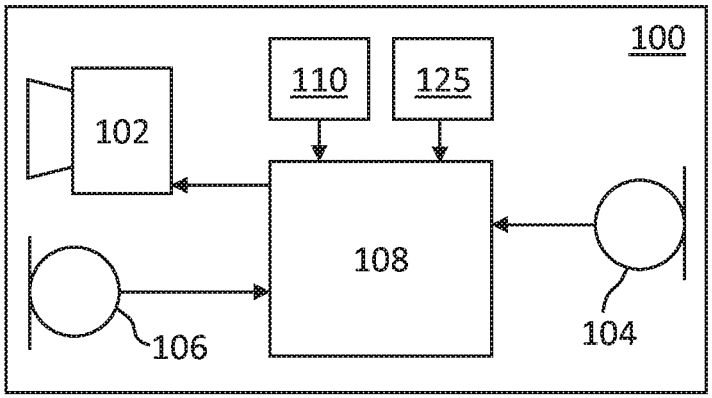
FIG. 2 is a schematic diagram of the personal audio device shown in FIG. 1.

FIG. 2 is a system schematic of the headphone 100. The headphone 100 may form part of a headset comprising another headphone (not shown) configured in substantially the same manner as the headphone 100.

A digital signal processor 108 of the headphone 100 is configured to receive microphone signals from the microphones 104, 106. When earbud 100 is positioned within the ear canal, microphone 104 is occluded to some extent from the external ambient acoustic environment. The headphone 100 may be configured for a user to listen to music or audio, to make telephone calls, and to deliver voice commands to a voice recognition system, and other such audio processing functions.

The processor 108 may be further configured to adapt the handling of such audio processing functions in response to one or both earbuds being positioned on the ear or being removed from the ear. The headphone 100 further comprises a memory 110, which may in practice be provided as a single component or as multiple components. The memory 110 is provided for storing data and program instructions. The headphone 100 further may further comprise a transceiver 112, which is provided for allowing the headphone 100 to communicate (wired or wirelessly) with external devices, such as another headphone, or a mobile device (e.g. smartphone) to which the headphone 100 is coupled. Such communications between the headphone 100 and external devices may comprise wired communications where suitable wires are provided between left and right sides of a headset, either directly such as within an overhead band, or via an intermediate device such as a mobile device. The headphone may be powered by a battery and may comprise other sensors (not shown).

Each of the microphones 104, 106 has an associated acoustic resonance caused by porting of the microphone to the air. As described in US patent application number 10,368,178 B2, the content of which is hereby incorporated by reference in its entirety, the frequency of the acoustic resonance associated with a microphone is dependent on the temperature at the microphone. Analysis shows that for a port with total volume V, length l and port area $S_A$, the resonance frequency of the microphone can be approximated by:

$$f_H = \frac{v}{2\pi}\sqrt{\frac{S_A}{l * V}}$$

Where v is the speed of sound.

An indication of the quality factor $Q_H$ of the resonance peak may also be determined. As is known in the art, the quality factor of a feature such as a resonance peak is an indication of the concentration or spread of energy of the resonance around the resonance frequency $f_H$, i.e. an indication of how wide or narrow the resonance peak is in terms of frequency. A higher quality factor $Q_H$ means that most of the energy of the resonance is concentrated at the resonance frequency $f_H$ and the signal magnitude due to the resonance drops off quickly for other frequencies. A lower quality factor $Q_H$ means that frequencies near the peak resonance frequency $f_H$ may also exhibit some relatively significant signal magnitude.

To a first order analysis, the quality factor $Q_H$ of a microphone may be given as $$Q_H = 2\pi\sqrt{V\left(\frac{l}{S_A}\right)^3}$$

Substituting v with its equivalent temperature term gives $$f_H = \frac{c331.3}{2\pi}\sqrt{\left(\frac{\theta}{273.15}+1\right)\frac{S_A}{l * V}}$$

Where θ is the temperature in degrees Celsius.

It can be seen from the above that the quality factor $Q_H$ of the resonance peak will vary with the area $S_A$ of the acoustic port 110 but that the quality factor $Q_H$ is not temperature dependent.

On the contrary, it can be seen that a change in air temperature at a microphone will result in a change in the speed of sound which results in a change in the resonance frequency $f_H$ of the resonant peak.

It is also noted that partial or complete closure, i.e. blocking, of the acoustic port, resulting in a change in port area, would be expected to result in a change in both the resonance frequency $f_H$ of the resonance peak and also the quality factor $Q_H$. Determining both the resonance frequency $f_H$ of the resonance peak, that is the frequency of the peak, and also the quality factor $Q_H$ thus allows for discrimination between changes in the resonance peak profile due to blockage in an acoustic port and changes due to temperature variation.

Embodiments of the present disclosure use the above phenomenon for the purpose of determining temperatures at microphones 104, 106 positioned towards the inside of the headphone 100 facing the ear canal 12*b* and towards outside of the headphone 100 facing away from the ear. By monitoring the resonance frequency of one or more of the microphones 104, 106, an indication can be determined as to whether or not the headphone 100 is positioned on or in the ear.

Figure 3:
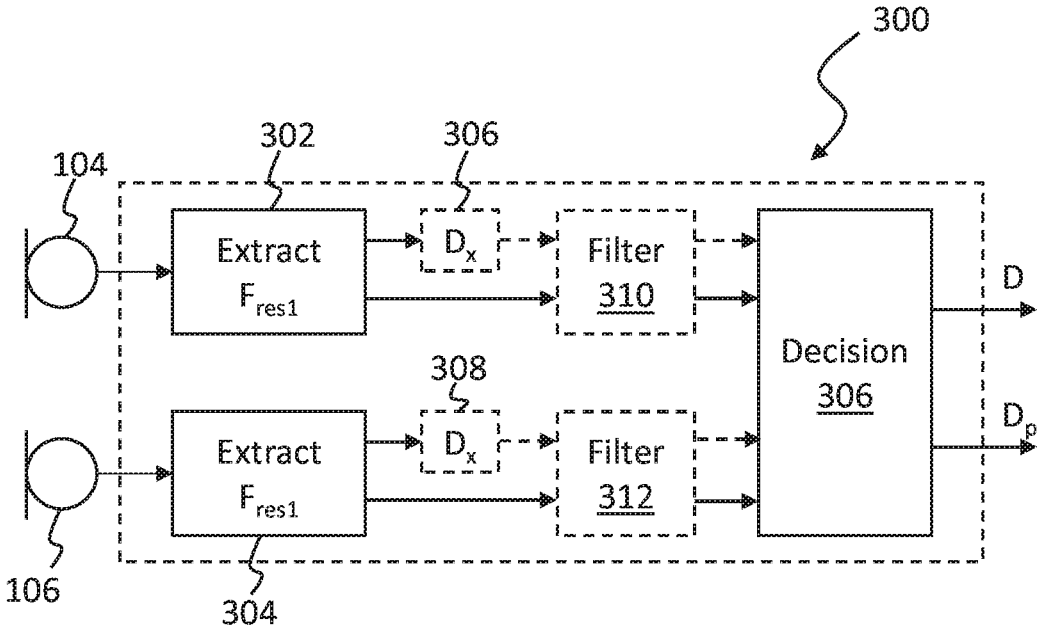
FIG. 3 is a block diagram of an on ear detect (OED) module.

FIG. 3 is a block diagram of an on ear detect (OED) module 300 which may be implemented by the DSP 108 or another processor of the headphone 100. The OED module 300 is configured to receive audio signals from one or more of the microphone(s) 104, 106. At the very least, the OED module 300 may receive an audio signal from the one or more microphones 104 located at or proximate to an internal surface of the headphone such that, in use, the microphone 104 faces the ear canal. In some embodiments, the OED module 300 may also receive one or more audio signals from the one or more microphones 106 (e.g. reference microphones) located on or proximate an external surface of the headphone 100. The one or more (error) microphones 104 and one or more reference microphones 106 will herein be described respectively as internal and external microphones 104, 106 for the sake of clear explanation. It will be appreciated that any number of microphones may be input to the OED module 300.

The OED module 300 comprises first and second feature extract modules 302, 304 configured to determine a resonance frequency of respective internal and external microphones 104, 106 based on the audio signals derived from the internal and external microphones 104, 106. In some embodiments, the first and second feature extract modules 302, 304 may be replaced with a single module configured to perform the same function. The feature extract modules 302, 304 may each be configured to output a signal representative of the resonance frequency of microphones 104, 106. This signal may comprise a frequency itself and/or a temperature value determined based on the determined resonance frequency.

It will be appreciated that the device characteristics of the internal and external microphones 104, 106 may not be the same. The relationship between resonance frequency and temperature for the microphones 104, 106 may therefore differ, such that the same resonance frequency for the two microphones 104, 106 may correspond to two different temperatures. Where the device characteristics of the first and second microphones 104, 106 differ, the feature extract modules 302, 304 may be configured to normalise the extracted resonance frequency value such that subsequent comparison of respective resonance frequencies will provide an accurate comparison with respect to temperature at the microphones 104, 106.

As previously discussed, determining both the resonance frequency $f_H$ of the resonance peak, that is the frequency of the peak, and also the quality factor $Q_H$ allows for discrimination between changes in the resonance peak profile due to blockage in an acoustic port and changes due to temperature variation. Accordingly, in some embodiments, the feature extract modules 302, 304 may additionally determine the quality factor $Q_H$ for signals derived from the one or more internal microphones 104 and the one or more external microphones 106. These determined quality factors $Q_H$ may be used to reduce erroneous on ear detect decisions due to microphone blockage or the like.

Optionally, the OED module 300 may further comprise one or more derivative modules 306, 308 configured to determine a derivative of the signals output from the frequency extract modules 302, 304. The derivative modules 306, 308 may each be configured to determine one or more first order, second order or subsequent order derivatives of the signals received from the frequency extract modules 302, 304 and output these determined derivatives. In doing so, the derivative modules 306, 308 may determine a change and/or rate of change in resonance frequency extracted by the frequency extract modules 302, 304.

Optionally, the OED module 300 may further comprise one or more filter modules 310, 312 configured to filter signals output from one or more of the frequency extract modules 302, 304 and the derivative modules 306, 308. The filter modules 310, 312 may apply one or more filters, such as median filters or low pass filters to received signals and output filtered versions of these signals.

The OED module 300 further comprises a decision module 314. The decision module 314 is configured to receive one or more resonance frequency signals, temperature signals, quality factor signals and derivative signals from the frequency extract modules 302, 304 and derivative modules 306, 308, optionally filtered by the filter modules 310, 312. Based on these received signals, the decision module 314 may then determine and output an indication as to whether the headphone 100 is on ear. The determined indication may be a "soft" indication (e.g. a probability of whether the headphone 100 is on ear) or a "hard" indication (e.g. a binary output). Thus, the decision module 314 may output a "soft" non-binary decision $D_p$ representing a probability of the headphone 100 being on ear. Additionally, or alternatively to the non-binary decision $D_p$, the decision module 314 may output a "hard" binary decision D. In some embodiments, the binary decision D is obtained by slicing or thresholding the non-binary decision $D_p$.

Operation of the decision module 314 according to various embodiments will now be described with reference to FIGS. 4 to 9. As mentioned above, in preferred embodiments, temperature at the internal and/or external microphones 104, 106 need not be calculated. Instead, the resonance frequency can be used directly for the purpose of determining an on ear indication. In the following examples, however, the temperature at the microphones 104, 106 is shown to provide context to the skilled reader.

Figure 4:
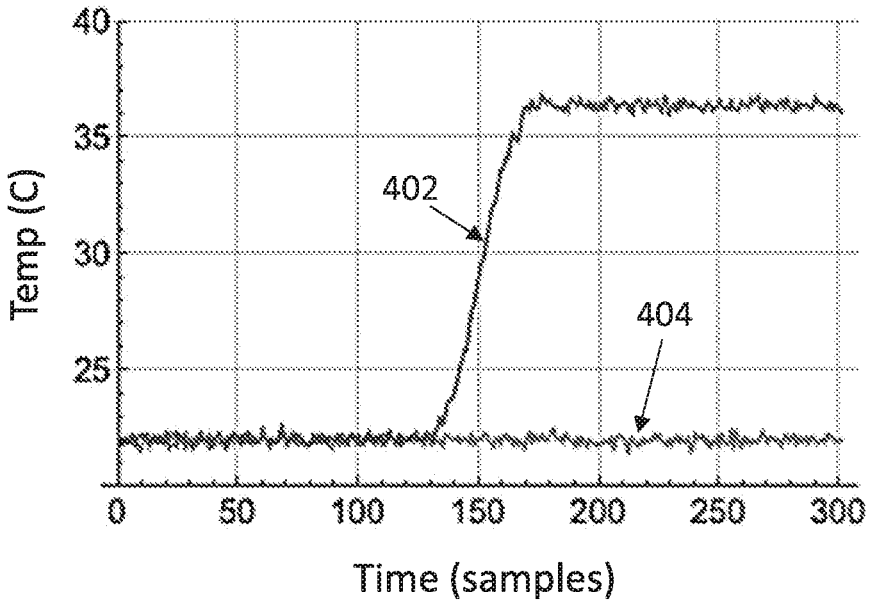
FIG. 4 is a plot of temperature vs time during insertion of the personal audio device of FIG. 2.

FIG. 4 is a plot of temperature vs time for an insertion event in which the headphone 100 is inserted into the ear canal 12*b*.

The respective temperature plots 402, 404 were calculated by the frequency extract modules 302, 304 based on the extracted resonance frequencies of the first and second microphones 104, 106. During the insertion event, the temperature at the external microphone 106 remains constant as depicted by the temperature plot 404 which shows a steady temperature of 22 degrees C. In contrast, the temperature plot 402 for the internal microphone depicts an increase in temperature at the internal microphone 104 to close to body temperature, around 36.5 degrees C.

A change in temperature at the internal microphone 104 may thus be used by the decision module 314 to indicate that the headphone 100 has been placed into the ear canal 12*b* of a user. The concurrent presence of a steady temperature at the external microphone 106 can provide additional support for an on ear indication.

Figure 5:
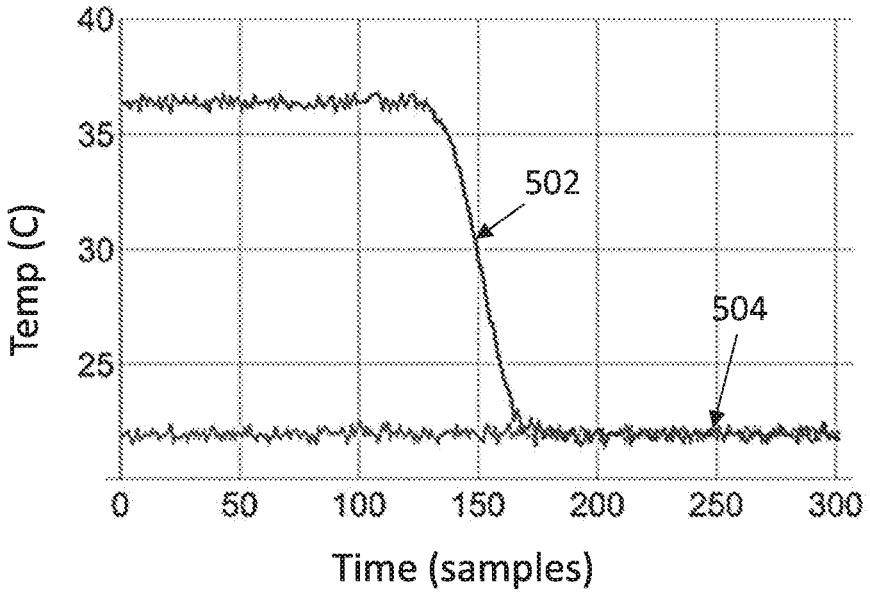
FIG. 5 is a plot of temperature vs time during removal of the personal audio device of FIG. 2.

FIG. 5 is a plot of temperature vs time for temperature for a removal event in which the headphone 100 is removed from the ear canal 12*b*. The respective temperature plots 502, 504 were again calculated by the frequency extract modules 302, 304 based on the extracted resonance frequencies of the first and second microphones 104, 106. During the removal event, the temperature at the external microphone 106 remains constant as depicted by the temperature plot 504 which shows a steady temperature of 22 degrees C. In contrast, the temperature plot 502 for the internal microphone 104 depicts a decrease in temperature at the internal microphone 104 to close to body temperature, around 36.5 degrees C.

In view of the above, a change in temperature at the internal microphone 104 may be used by the decision module 314 to indicate that the headphone 100 has been removed from the ear canal 12*b* of a user. The concurrent presence of a steady temperature at the external microphone 106 can provide additional support for an off ear indication or an indication of a removal event.

Figure 6:
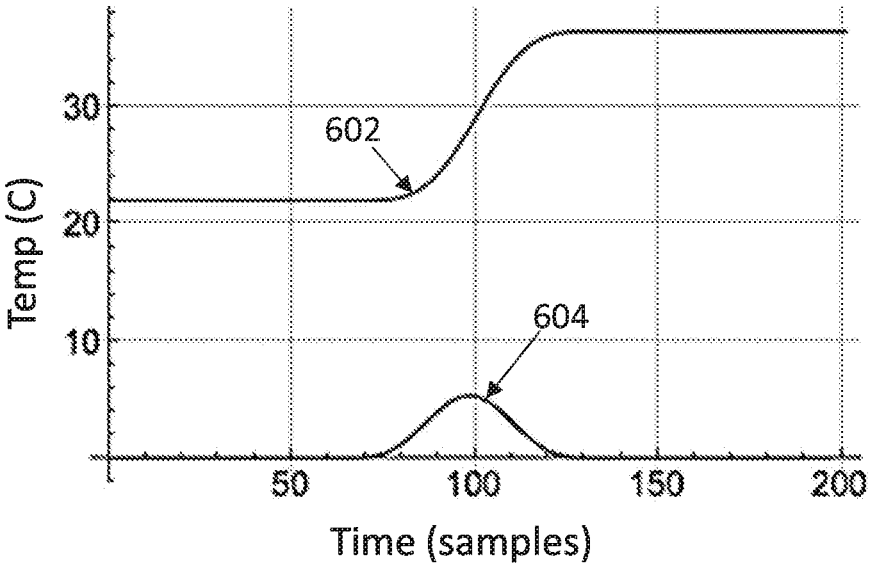
FIG. 6 is a plot showing temperature over time together with a first derivative of temperature during insertion of the personal audio device of FIG. 2.

FIG. 6 is a plot showing the temperature 602 over time together with a first derivative 604 of temperature for an insertion event in which the headphone 100 is inserted into the ear canal 12*b*. The temperature 602 was calculated by the frequency extract module 302 based on the extracted resonance frequency of the internal microphone 104. During the insertion event, an increase in temperature is observed at the internal microphone 104 to close to body temperature, around 36.5 degrees C. This change is also shown in the first derivative 604. The peak of the first derivative 604 indicates a change in temperature at the internal microphone 104. An early estimate of final temperature can also be acquired from the derivative, given by:

$$\theta^*=\theta_o+2(\theta_{DP}-\theta_o)$$

Where $\theta_o$ is the temperature when the first derivative 604 is zero (or below a threshold), and $O_{DP}$ is the temperature at the peak of the first derivative 604. For the example shown in FIG. 6:

$$\theta^*=22+2*(29-22)$$

$$\theta^*=36^\circ\ C.$$

Thus, an estimate of final temperature at the internal microphone 104 can be ascertained around halfway through the temperature transition. The decision module 314 may further determine whether this estimate is within an expected temperature in the ear canal, e.g. by comparing the estimated final temperature with an expected temperature range. Accordingly, the decision module 314 may use temperature (calculated from the resonance frequency) of the internal microphone 104 together with the first derivative of that calculated temperature to determine an indication that the headphone 100 is on the ear, not on the ear, or that the headphone 100 is being inserted or removed from the ear.

An even early estimate may also be made by considering the value of temperature at the point at which the second derivative peaks.

Figure 7:
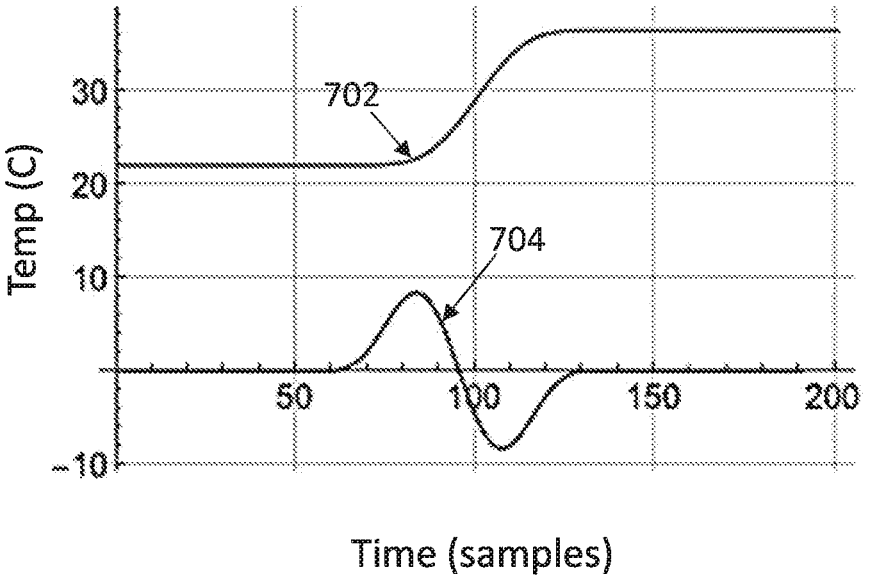
FIG. 7 is a plot showing temperature over time together with a second derivative of temperature during insertion of the personal audio device of FIG. 2.

FIG. 7 is a plot showing the temperature 702 over time together with a second derivative 704 of temperature for an insertion event in which the headphone 100 is inserted into the ear canal 12*b*. The temperature 702 was calculated by the frequency extract module 302 based on the extracted resonance frequency of the internal microphone 104. During the insertion event, an increase in temperature at the internal microphone 104 to close to body temperature, around 36 degrees C., is observed. The temperature 702 can be monitored at inflection points and peaks of the double derivative 704. In similar manner to that described for the first derivative 604, the final temperature may be estimated based on the original temperature and the temperature at the first peak of the second derivative 704.

In some embodiments, the decision module 314 may use a prediction filter to estimate the final temperature $\theta^*$ based on the derivative (first or second order) and the initial temperature. The prediction filter may receive, as inputs, the one or more resonance frequency signals, temperature signals, quality factor signals and derivative signals from the frequency extract modules 302, 304 and derivative modules 306, 308. The prediction filter may be implemented as a neural network trained on data pertaining to on ear and off ear conditions at the microphones 104, 106 or other elements of the headphone 100. The prediction filter may thereby avoid false positive on ear indications due to temperature changes not associated with placing the headphone in or on the ear.

It will be appreciated that the repeated calculation of derivatives may introduce unwanted noise gain, thereby reducing the accuracy the estimate of final temperature.

To improve performance in the presence of noise, a robust derivative may be implemented by the derivative modules 306, 308. For example, a standard convolution kernel may be written in the form:

$$K=\{-1,1\}$$

In contrast, a robust convolution kernel may be in the form:

$$K=\{2,1,0,-1,-2\}$$

Figures 8, 9:
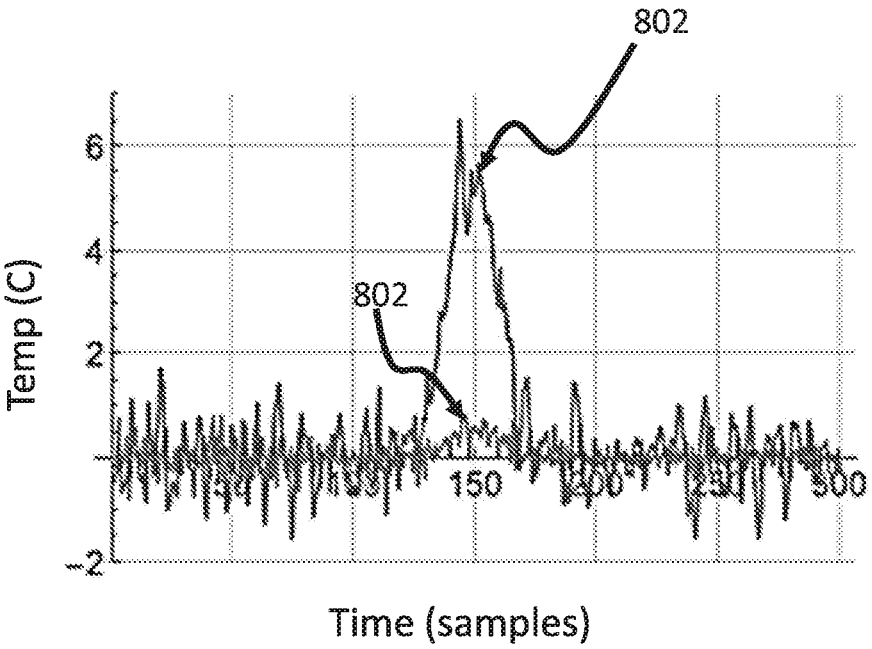
FIG. 8 is a plot showing a first order derivative calculated using a standard convolution kernel and a robust convolution kernel.
FIG. 9 is a decision plot illustrating the decision operation of a decision module of the on ear detect module shown in FIG. 3.

FIG. 8 is a plot showing the first order derivative calculated both by using the standard convolution kernel recited above (802) and the robust convolution kernel (804). The peak in the robust derivative 804 has a much greater amplitude than the peak of the standard derivative 802. Thus, the robust derivative 804 is thus less susceptible to noise gain.

FIG. 9 is a decision plot illustrating the decision operation of the decision module 314 according to some embodiments in which temperature at the internal and external microphones 104, 106 is determined by the frequency extract modules 302, 304.

If it is determined that the external temperature at the headphone 100 is out of a predetermined range and the body temperature measured at the internal microphone 104 is outside of a body temperature range, then the decision module 314 outputs and undefined decision, an error status or does not output a decision.

If it is determined that the external temperature at the headphone 100 is within a predetermined range and the internal microphone 104 is outside of a body temperature range, then the decision module 314 outputs an indication that the headphone 100 is off ear.

If it is determined that the external temperature at the headphone 100 is within a predetermined range and the internal microphone 104 is within of a body temperature range, then the decision module 314 outputs an indication that the headphone 100 is on ear.

If it is determined that the external temperature at the headphone 100 is outside of a predetermined range and the internal microphone 104 is within of a body temperature range, then the decision module 314 outputs an indication that the headphone 100 is off ear. Depending on the predetermined range for the external temperature, this scenario may cater for situations in which the headphone 100 is held in the hand of the user or placed in the pocket of clothes worn by the user. In which case, the both of the internal and external microphones 104, 106 may be be at a temperature close to body temperature.

As noted above, resonance frequency of the microphones 104, 106 is dependent on device dimensions and temperature and may differ from microphone to microphone due to variations in device dimensions. The resonant frequency of the microphones 104, 106 is proportional to $\sqrt{T}$ where T is the temperature in degrees Kelvin.

In some embodiments, a calibration process may be performed on each microphone to determine the relationship between resonance frequency and temperature for each microphone. During this procedure, a microphone may be placed in an environment at a known temperature $\theta_{CAL}$ and the resonant frequency $\omega_{CAL}$ of the microphone measured. This calibration process may be performed during manufacturing, for example on a factory floor which typically is accurately temperature controlled. In other embodiments, the resonant frequency co $\omega_{CAL}$ at a known temperature $\theta_{CAL}$ may be derived analytically.

To subsequently extract a temperature measurement $\theta_M$ (in ° C.), the extracted measurement of resonant frequency may be calibrated against the measured resonant frequency $\omega_{CAL}$ at $\theta_{CAL}$:

$$\theta_M = \left(\frac{\omega_M}{\omega_{CAL}}\right)^2 \theta_{CAL} - 273.15$$

Where $\omega_M$ is the measured resonant frequency and 273.15 is the correction factor between degrees Kelvin and degrees Celsius.

As mentioned above, in some embodiments the headphone 100 may form part of a headset with another headphone implementing the same or similar on ear detection. In addition, or alternatively, the headphone 100 or another headphone may implement additional on ear detection techniques using signal features from microphones and/or other sensors integrated into such headphones. In such situations, decisions (hard or soft) output from two or more on ear detection modules may be combined to determine a final decision.

Figure 10:
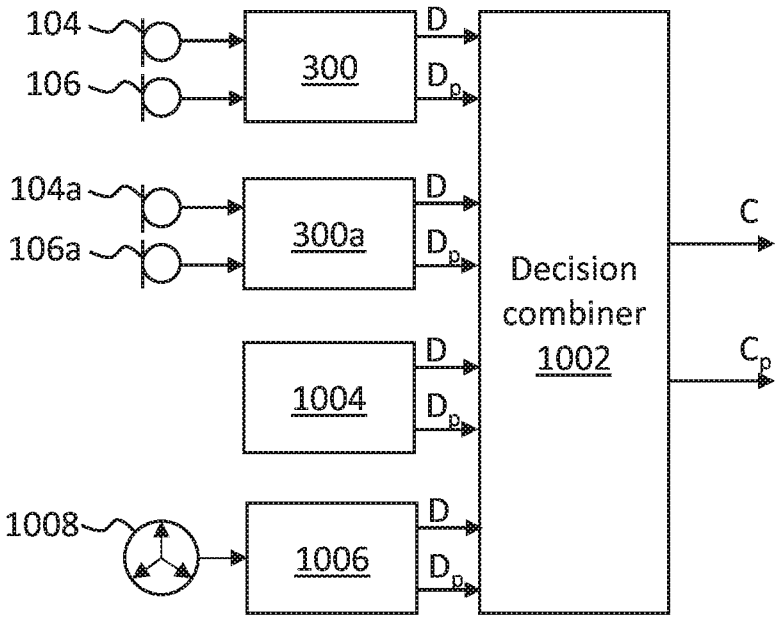
FIG. 10 is a block diagram of a decision combiner.

FIG. 10 is a block diagram depicting a decision combiner 1002 configured to combine on ear indications (hard and/or soft) received from various sources. In some embodiments, the decision combiner 1002 may be implemented by the headphone 100, another headphone, or an associated device such as a smartphone. One or more functions of the decision combiner 1002 may be implemented at a location remote to the headphone 100, the other headphone or the associated device.

The decision combiner 1002 may receive an on ear indication (hard and/or soft) from the OED module 300 of the headphone 100. Additionally, the decision combiner 1002 may receive an on ear indication (hard and/or soft) from another OED module 300*a* of another headphone (not shown) comprising internal and external microphones 104*a*, 106*a*. Additionally or alternatively, the decision combiner 1002 may receive an on ear indication (hard and/or soft) from an on ear detect module 1004 configured to use features of signals derived from the microphones 104, 106 other than resonance frequency, to determine the on ear indication. An example of such on ear detect module is described in U.S. Pat. No. 10,264,345 B1, the content of which is incorporated by reference in its entirety. Additionally, or alternatively, the decision combiner 1002 may receive an in ear indication (hard and/or soft) from an accelerometer on ear detect module 1006 which may receive an orientation signal from an accelerometer 1008 integrated into the headphone 100 or another headphone. The accelerometer on ear detect module 1006 may determine an indication (hard and/or soft) as to whether the headphone 100 is on ear based on the orientation detected by the accelerometer 1008.

The decision combiner 1002 may combine outputs from one or more of the on ear detect modules 300, 300*a*, 1004, 1008 to determine and overall or combined on ear indication in the form of a binary flag C and/or a non-binary probability $C_p$.

The skilled person will recognise that some aspects of the above-described apparatus and methods may be embodied as processor control code, for example on a non-volatile carrier medium such as a disk, CD- or DVD-ROM, programmed memory such as read only memory (Firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

Note that as used herein the term module shall be used to refer to a functional unit or block which may be implemented at least partly by dedicated hardware components such as custom defined circuitry and/or at least partly be implemented by one or more software processors or appropriate code running on a suitable general purpose processor or the like. A module may itself comprise other modules or functional units. A module may be provided by multiple components or sub-modules which need not be co-located and could be provided on different integrated circuits and/or running on different processors.

Embodiments may be implemented in a host device, especially a portable and/or battery powered host device such as a mobile computing device for example a laptop or tablet computer, a games console, a remote control device, a home automation controller or a domestic appliance including a domestic temperature or lighting control system, a toy, a machine such as a robot, an audio player, a video player, or a mobile telephone for example a smartphone.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

The invention claimed is:

1. A method for on ear detection for a headphone, the method comprising:

receiving a first microphone signal derived from an first microphone of the headphone and determining, from the first microphone signal, a first resonance frequency associated with an acoustic port of the first microphone, the first resonance frequency dependent on a first temperature at the first microphone;

receiving a second microphone signal derived from an second microphone of the headphone and determining, from the second microphone signal, a second resonance frequency associated with an acoustic port of the second microphone, the second resonance frequency dependent on a second temperature at the second microphone; and determining an indication of whether the headphone is on ear based on the first and second resonance frequencies.

2. The method of claim 1, wherein determining the indication of whether the headphone is on ear comprises comparing the first and second resonance frequencies.

3. The method of claim 1, wherein determining the indication of whether the headphone is on ear comprises:

determine the first temperature at the first microphone and the second temperature at the second microphone based on the respective first and second resonance frequencies; and determining the indication of whether the headphone is on ear based on the first and second temperatures.

4. The method of claim 1, wherein determining the indication of whether the headphone is on ear based on the first and second resonance frequencies comprises detecting a change in the difference between the first and second resonance frequencies over time.

5. The method of claim 1, further comprising filtering the first and second resonance frequencies before determining whether the headphone is on ear.

6. The method of claim 1 is, wherein determining the indication of whether the headphone is on ear comprises: determining one or more derivatives of the first resonance frequency over time.

7. The method of claim 6, wherein determining the indication of whether the headphone is on ear comprises:

determine a change in the first resonance frequency based on the one or more derivatives and the first resonance frequency.

8. The method of claim 6, wherein a prediction filter is used to determine whether the headphone is on ear based on the one or more derivatives and the first resonance frequency.

9. The method of claim 3, further comprising:

comparing the first resonance frequency to a first resonance frequency range associated with the first microphone over a body temperature range; and determining that the headphone is on ear only if the first falls within the first resonance frequency range.

10. The method of claim 9, further comprising:

comparing the second resonance frequency to a second resonance frequency range associated with the second microphone over an air temperature range; and determining that the headphone is on ear only if the first resonance frequency falls within the first resonance frequency range and the second resonance frequency falls within the second resonance frequency range.

11. A method for on ear detection for a headphone, the method comprising:

receiving a first microphone signal derived from a first microphone of the headphone and determining, from the first microphone signal, a first resonance frequency associated with the acoustic port of the first microphone, the first resonance frequency dependent on a first temperature at the first microphone;

detecting a change in the first resonance frequency over time; and determining an indication of whether the headphone is on ear based on the change in resonance frequency and the resonance frequency after the change.

12. The method of claim 11, wherein determining the indication of whether the headphone is on ear comprises:

determine a first temperature at the first microphone based on the first resonance frequency; and determining the indication of whether the headphone is on ear based on the first temperature.

13. The method of claim 11, further comprising detecting an insertion event or a removal event based on the change in the resonance frequency and the resonance frequency after the change.

14. The method of claim 11, further comprising filtering the first resonance frequency before determining whether the headphone is on ear.

15. The method of claim 11, wherein determining the change in the first resonance frequency comprises:

determining one or more derivatives of the first resonance frequency over time.

16. The method of claim 15, wherein a prediction filter is used to determine whether the headphone is on ear based on the one or more derivatives and the first resonance frequency.

17. The method of claim 12, further comprising:

comparing the first resonance frequency to a first resonance frequency range associated with the first microphone over a body temperature range; and determining that the headphone is on ear only if the first resonance frequency falls within the first resonance frequency range.

18. An apparatus for on ear detection for a headphone, the apparatus comprising:

a first input for receiving a first microphone signal derived from a first microphone of the headphone;

a second input for receiving a second microphone signal derived from a second microphone of the headphone;

one or more processors configured to:

determine, from the first microphone signal, a first resonance frequency associated with an acoustic port of the first microphone, the first resonance frequency dependent on a first temperature at the first microphone;

determine, from the second microphone signal, a second resonance frequency associated with an acoustic port of the second microphone, the second resonance frequency dependent on a second temperature at the second microphone; and determine an indication of whether the headphone is on ear based on the first and second resonance frequencies.

19. An apparatus for on ear detection for a headphone, the apparatus comprising:

an input for receiving a first microphone signal derived from a first microphone of the headphone;

one or more processors configured to:

determine, from the first microphone signal, a first resonance frequency associated with the acoustic port of the first microphone, the first resonance frequency dependent on a first temperature at the first microphone;

detect a change in the first resonance frequency over time; and determine an indication of whether the headphone is on ear based on the change in resonance frequency and the resonance frequency after the change.

20. A non-transitory computer readable storage medium having computer-executable instructions stored thereon that, when executed by one or more processors, cause the one or more processors to perform a method according to claim 1.

* * * * *